US010760560B2

(12) United States Patent
Boyd

(10) Patent No.: US 10,760,560 B2
(45) Date of Patent: Sep. 1, 2020

(54) GAS DISPLACEMENT PUMP ASSEMBLY

(71) Applicant: CryoVation, LLC, Hainesport, NJ (US)

(72) Inventor: Nathan Boyd, Hainesport, NJ (US)

(73) Assignee: Cryovation, LLC., Hainesport, NJ (US)

( * ) Notice: Subject to any disclaimer, the term of this patent is extended or adjusted under 35 U.S.C. 154(b) by 855 days.

(21) Appl. No.: 15/248,946

(22) Filed: Aug. 26, 2016

(65) Prior Publication Data

US 2017/0059242 A1 Mar. 2, 2017

Related U.S. Application Data

(60) Provisional application No. 62/211,648, filed on Aug. 28, 2015.

(51) Int. Cl.
*F17C 3/00* (2006.01)
*F17C 5/02* (2006.01)
(Continued)

(52) U.S. Cl.
CPC ..... *F04B 35/04* (2013.01); *F04B 15/00* (2013.01); *F04B 39/06* (2013.01); *F04B 41/00* (2013.01); *F17C 6/00* (2013.01); *F17C 7/00* (2013.01); *F17C 9/00* (2013.01); *F17C 13/00* (2013.01); *F17C 2201/054* (2013.01); *F17C 2221/016* (2013.01); *F17C 2221/017* (2013.01); *F17C 2223/0123* (2013.01); *F17C 2223/033* (2013.01); *F17C 2223/043* (2013.01); *F17C 2225/0123* (2013.01); *F17C 2225/0161* (2013.01); *F17C 2225/033* (2013.01); *F17C 2225/035* (2013.01); *F17C 2225/044* (2013.01); *F17C 2227/015* (2013.01); *F17C 2227/0355* (2013.01); *F17C 2227/0374* (2013.01); *F17C 2250/032* (2013.01); *F17C 2250/0439* (2013.01); *F17C 2250/061* (2013.01);
(Continued)

(58) Field of Classification Search
CPC ..... F17C 3/00; F17C 5/02; F17C 5/04; F17C 6/00; F17C 2227/0128; F17C 2227/0135; F17C 2227/0341; F17C 2227/0395; F17C 5/06; F17C 2223/0123; F17C 2225/0115; F17C 2225/0123; F17C 2221/017; F25B 9/00; F25B 19/005; F25J 1/0225; F25J 1/0007; F25J 1/0072; F04B 15/06; F04B 15/08; F04B 2015/081; F04B 2015/0812; F04B 2015/0814; F04B 2015/0816; F04B 2015/0818; F04B 2015/082; F04B 2015/0822; F04B 2015/0824; F04B 2015/0826
See application file for complete search history.

(56) References Cited

U.S. PATENT DOCUMENTS 3,722,581 A * 3/1973 Sauer ..... F25J 5/002 165/96
4,032,337 A * 6/1977 Boyer ..... B22F 3/15 137/563
(Continued)

*Primary Examiner* — Frantz F Jules
*Assistant Examiner* — Erik Mendoza-Wilkenfel
(74) *Attorney, Agent, or Firm* — Schott, PC.

(57) ABSTRACT

A gas displacement assembly includes a storage container, a pump that pumps a pressurized gas material into the storage container, a cooling chamber that houses a coolant and cools the gas material to a cryogenic temperature, and a coolant line that transports coolant through the cooling chamber to cool the gas material.

17 Claims, 5 Drawing Sheets

(51) Int. Cl.

| | |
|---|---|
| ***F17C 6/00*** | (2006.01) |
| ***F25B 9/00*** | (2006.01) |
| ***F04B 15/06*** | (2006.01) |
| ***F04B 15/08*** | (2006.01) |
| ***F04B 35/04*** | (2006.01) |
| ***F04B 15/00*** | (2006.01) |
| ***F04B 39/06*** | (2006.01) |
| ***F17C 7/00*** | (2006.01) |
| ***F17C 13/00*** | (2006.01) |
| ***F04B 41/00*** | (2006.01) |
| ***F17C 9/00*** | (2006.01) |

(52) U.S. Cl.
CPC .. *F17C 2260/035* (2013.01); *F17C 2265/033* (2013.01); *F17C 2265/034* (2013.01); *F17C 2265/037* (2013.01); *F17C 2270/05* (2013.01)

(56) References Cited

U.S. PATENT DOCUMENTS

| | | | | | |
|---|---|---|---|---|---|
| 4,559,786 | A * | 12/1985 | Schuck | F01B 9/02 | 417/901 |
| 6,152,192 | A * | 11/2000 | Klotz | F17C 5/002 | 141/104 |
| 2005/0000802 | A1* | 1/2005 | Hobbs | C01B 3/34 | 204/277 |
| 2010/0170297 | A1* | 7/2010 | Oka | F17C 9/04 | 62/614 |

* cited by examiner

GAS DISPLACEMENT PUMP ASSEMBLY

CROSS REFERENCE TO RELATED APPLICATION

This application claims the benefit of U.S. Provisional Patent Application No. 62/211,648, filed Aug. 28, 2015, which is incorporated herein by reference as if fully set forth.

FIELD OF THE INVENTION

This application relates generally to gas displacement pump assemblies.

BACKGROUND

Pumping is an example of a method typically used to fill compressed gas cylinders with compressed gasses. According to such a method, a gas material is typically pumped in liquid form through a heat exchanger using a cryogenic pump. The heat exchanger converts the liquid into gas form by increasing the material's temperature. The gas then exits the heat exchanger and is transferred into compressed gas cylinders.

One drawback to conventional methods results from the fact that many liquefied gases, such as helium, may be expensive and difficult to maintain, due for example, to vaporization and resultant pressure changes over time. Further, pumping liquefied helium is impractical, therefore a gas booster pump is used.

Pumping liquefied helium with a cryogenic pump also presents challenges. According to conventional methods, a pneumatic gas booster pump must be used to pump helium in order to achieve a higher ultimate pressure than the pressure supplied. However, pneumatic gas booster pumps are slow and require large air compressors to run. These large air compressors are expensive, often being valued many times above the cost of the pump itself. Furthermore, such systems typically generate a great deal of wasted energy and in turn heat, often utilizing exhaust air to cool the pump, as the heat of compression of the pumped gas can result in temperatures in excess of 200° F. if left uncooled.

SUMMARY OF THE EMBODIMENTS

The application relates to a gas displacement assembly, including: a storage container, a pump that pumps a pressurized gas material into the storage container, a cooling chamber that houses a coolant and cools the gas material to a cryogenic temperature, and a coolant line that transports coolant through the cooling chamber.

The application further relates to a gas displacement pump assembly, including: a storage container, a pump that pumps a gas material into the storage container, a vessel housing a supply of coolant, a cooling chamber, a coolant line that transfers coolant from the vessel to the cooling chamber, a gas source, and a gas line that transmits a gas material from the gas source through the cooling chamber and to the pump. The cooling chamber cools the gas material to a cryogenic temperature before the gas material reaches the pump.

The application further relates to a method of transferring a gas material into a storage container, including providing the gas material, providing the storage container, and providing a gas displacement pump assembly. The gas displacement pump assembly has a cooling chamber, a pump, a vessel housing a supply of coolant, and a coolant line, and a gas line. The method further includes transmitting coolant from the vessel, and through the coolant line to the cooling chamber, transmitting the gas material through the gas line into the cooling chamber, cooling the gas material to a cryogenic temperature in the cooling chamber to generate a cooled gas material, transmitting the cooled gas material from the cooling chamber to the pump, and pumping the cooled gas material into the storage container.

DETAILED DESCRIPTION OF THE EMBODIMENTS

Figure 1:
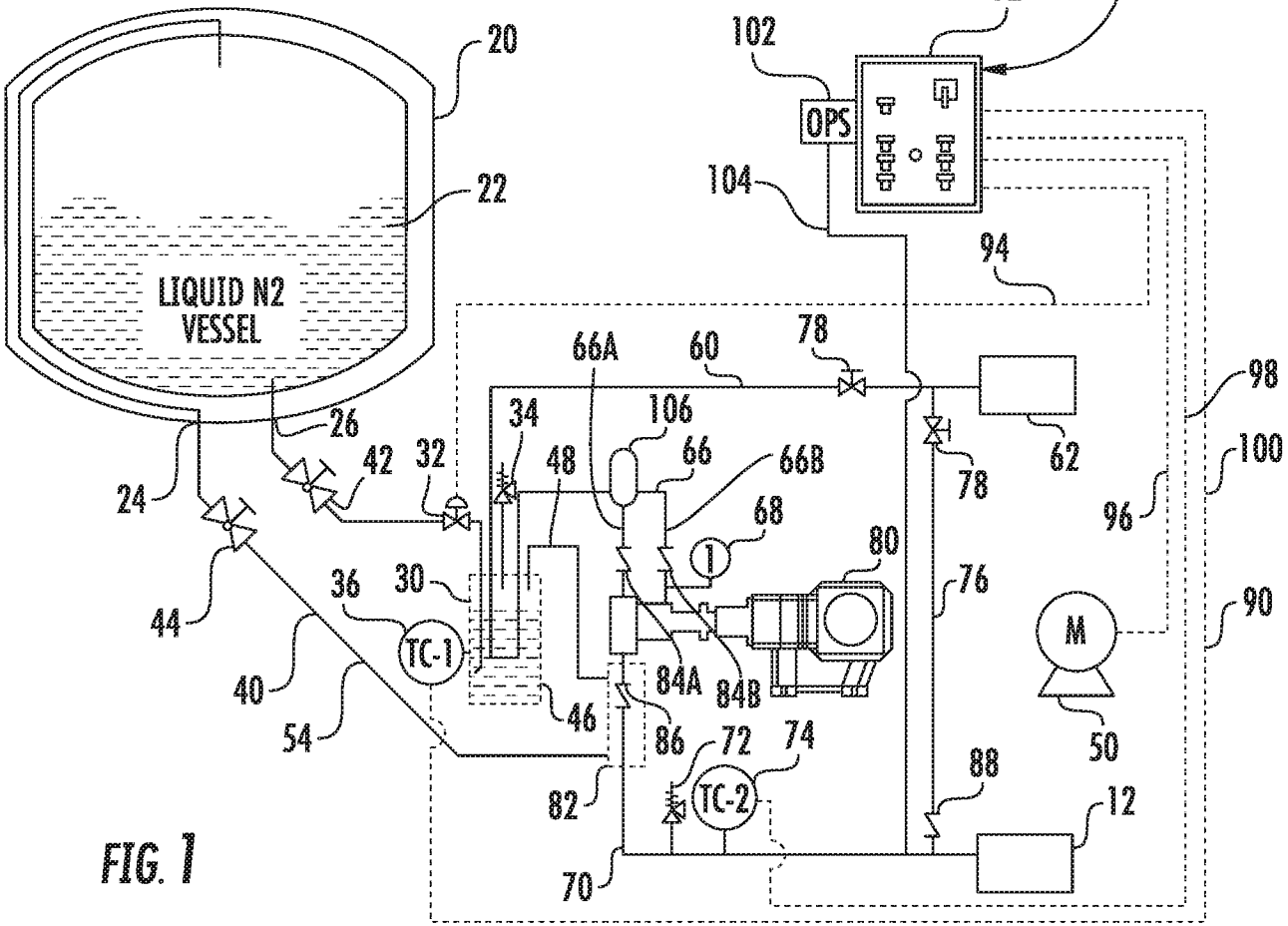
FIG. 1 is a schematic illustration of an embodiment of a gas displacement pump assembly.
Figure 3:
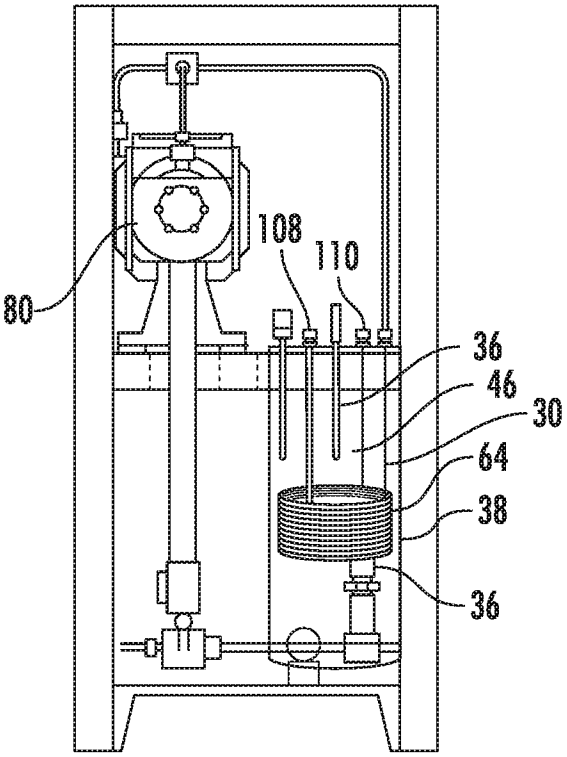
FIG. 3 is a front elevational view of the assembly of FIG. 1.
Figure 2:
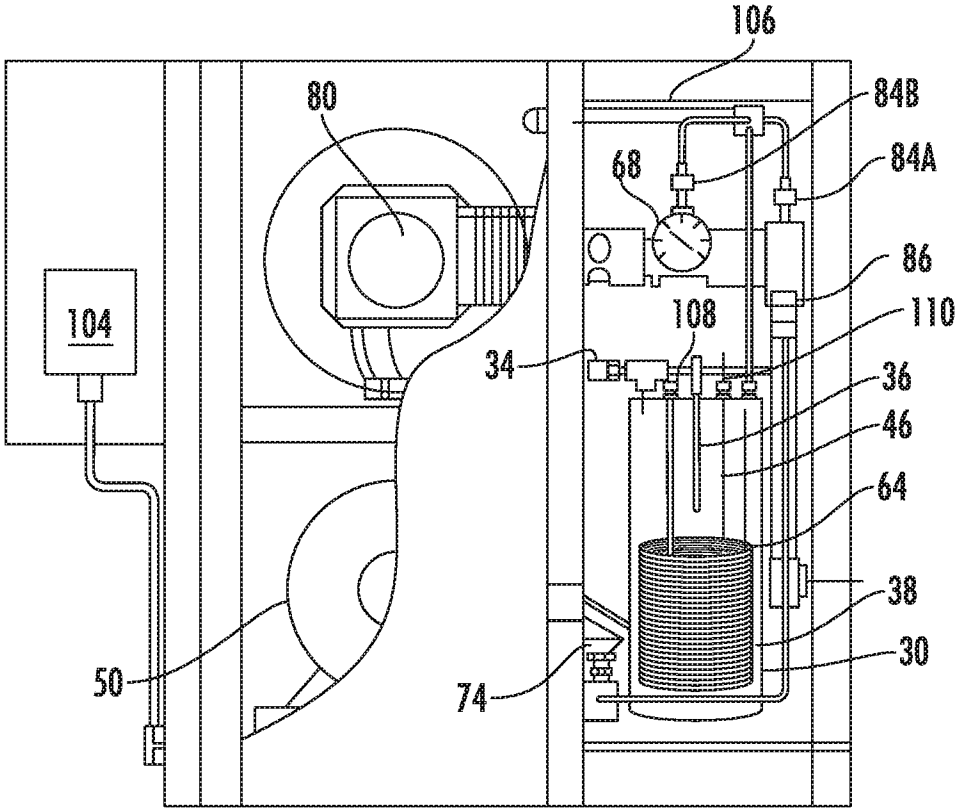
FIG. 2 is a side elevational view of the assembly of FIG. 1.

An embodiment of a gas displacement pump assembly 10 is shown in FIGS. 1-3. This embodiment of the assembly may be used for compression and liquefaction of a gas material for storage, as described below.

As used in this application and claims, the term "gas material" shall be defined as a material in a gas state at any stage of the transport and storage processes described in this application, and such a material may be referred to as a "gas material" even at times when such a material is in a non-gaseous state, such as a liquid state.

As shown, the assembly 10 comprises a coolant vessel 20 that houses a supply of coolant 22. The vessel 20 is in communication with a cooling chamber 30 via a coolant line 40. The cooling chamber 30 cools a supply of a gas material transmitted to the cooling chamber via a gas line 60, before transmitting the gas material to a filling pump 80 that compresses and pumps the gas material through an outlet 12 into a storage container, which may be a suitable gas storage cylinder.

Referring to FIG. 1, the coolant vessel 20 is formed as a chamber having an interior that houses the coolant 22. The coolant 22 of this embodiment is liquid nitrogen. The vessel 20 comprises a vapor return port 24 and a liquid supply port 26, each of which is in communication with a section of the coolant line 40.

The coolant line 40 forms a closed loop that commences at the liquid supply port 26, where coolant 22 exits the coolant vessel. An exit valve 42 may be located along the coolant line 40 just beyond the liquid supply port 26, for starting and stopping the flow of coolant 22 out from the vessel 20 via the liquid supply port 26. The coolant line 40 then travels through the cooling chamber 30 and cooling tower 82, as described in detail below, and returns to the coolant vessel 20 via the coolant line 40. The coolant line 40 may be formed of any conventional tubing known in the art that is suitable for transport of a coolant material. A return valve 44 may be located along the coolant line 40 just before it reaches the vapor return port 24 and returns to the coolant vessel 20, for starting and stopping the flow of coolant 22 back into the vessel 20.

The gas material of this embodiment is helium. Still referring to FIG. 1, the gas line 60 transmits the gas material, beginning at a gas source 62, through the cooling chamber 30, and then to the pump 80, which pumps the gas material through the cooling tower 82, through an outlet 12 leading into the storage container, as described in detail below. The gas line 60 may be formed of tubing material suitable for transport of a gas material in both gaseous and liquid states.

As shown, the coolant line 40 and the gas line 60 meet at the cooling chamber 30, at which point the gas material is cooled before being transferred to the pump 80 via gas line 60. Referring to FIG. 2, the cooling chamber 30 comprises a vacuum insulated receptacle 38 that houses coolant, which is transferred to the cooling chamber 30 via coolant line 40. The coolant enters the receptacle 38 via coolant feed 108 in a liquid state and forms a bath 46 within the cooling chamber 30. The gas line 60 extends to the cooling chamber 30, enters the receptacle 38 at gas feed 110, and forms a tubing coil 64 immersed in the bath 46. The tubing coil 64 could be formed of copper to provide optimal heat conduction. The gas material travels through the tubing coil 64 and is cooled by the bath 46 of coolant material within the cooling chamber 30. The cooling chamber 30 may be provided with a liquid solenoid valve 32 (FIG. 1) liquid level thermocouple 36 for controlling the temperature of the bath 46, and a relief valve 34 for controlling the pressure in the cooling chamber 30. The gas material of the embodiment shown may be cooled to cryogenic temperatures, for example, below −320° F./−195° C. in embodiments in which helium is the gas material.

Referring to FIG. 1, after being cooled in the cooling chamber 30, the gas material travels to the pump 80 via a section 66 of the gas line 60 extending between the cooling chamber 30 and pump 80. A reservoir 106 is located along section 66, and the gas material is fed into the reservoir 106 prior to reaching the pump 80. The reservoir 106 houses a reserve supply of the gas material, which is fed directly into the pump 80. Feeding gas material from the reserve supply helps increase efficiency in feeding the gas material to the pump 80 by providing a constant supply to draw from in feeding the gas material into the pump 80.

Section 66 of the gas line 60 splits into first 66A and second 66B branches between the pump 80 and reservoir 106. Branch 66A includes check valve 84A, and branch 66B includes check valve 84B. Gas material is driven from the reservoir 106 to the pump 80 by check valve 84B, through branch 66B. During pumping, some of the gas material may leak. For example, the pump 80 may include a head seal, which may be a common location for such leaks. Seal leak gauge 68 may be provided along section 66B, to detect such leaks, and check valve 84B may collect any leaked gas material leaked at the pump 80, and route it back to the reservoir 106 through branch 66A, effectively recirculating any leaked gas material back to the pump 80.

Figure 4:
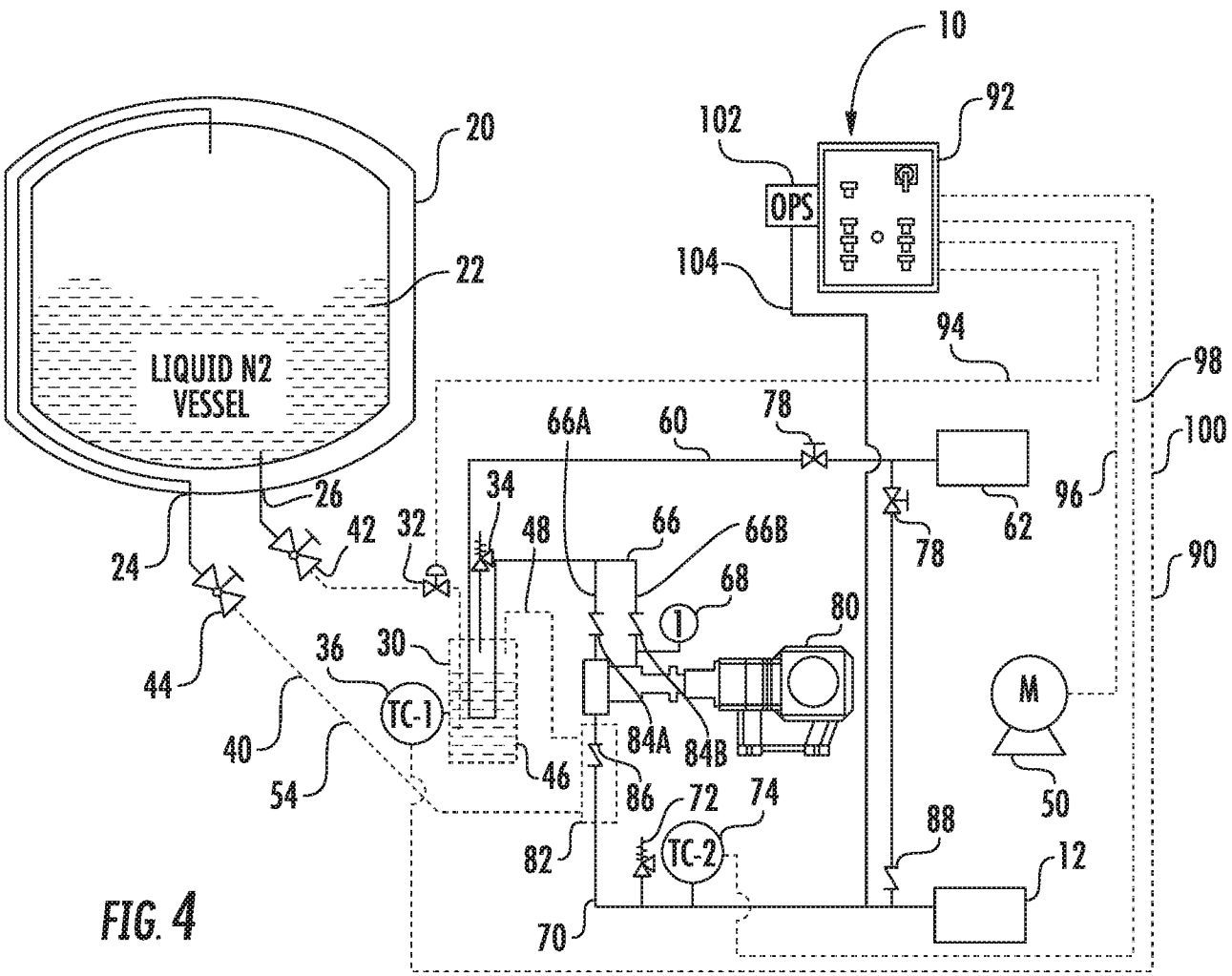
FIG. 4 is a schematic illustration of another embodiment of a gas displacement pump assembly.
Figure 6:
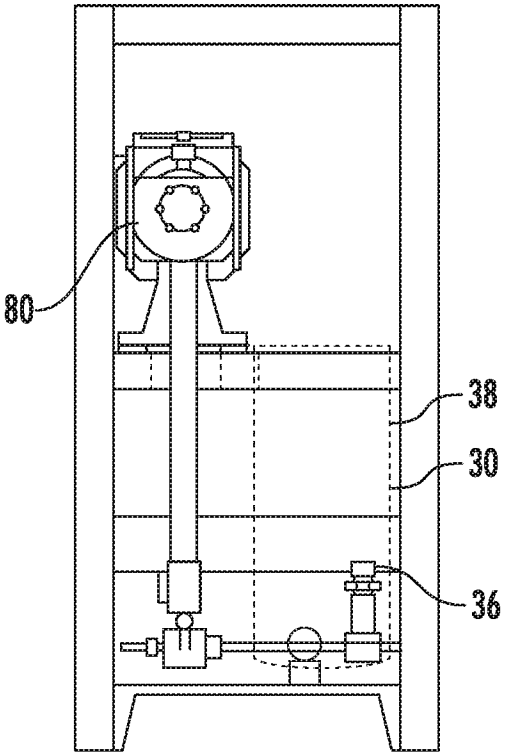
FIG. 6 is a front elevational view of the assembly of FIG. 4.
Figure 5:
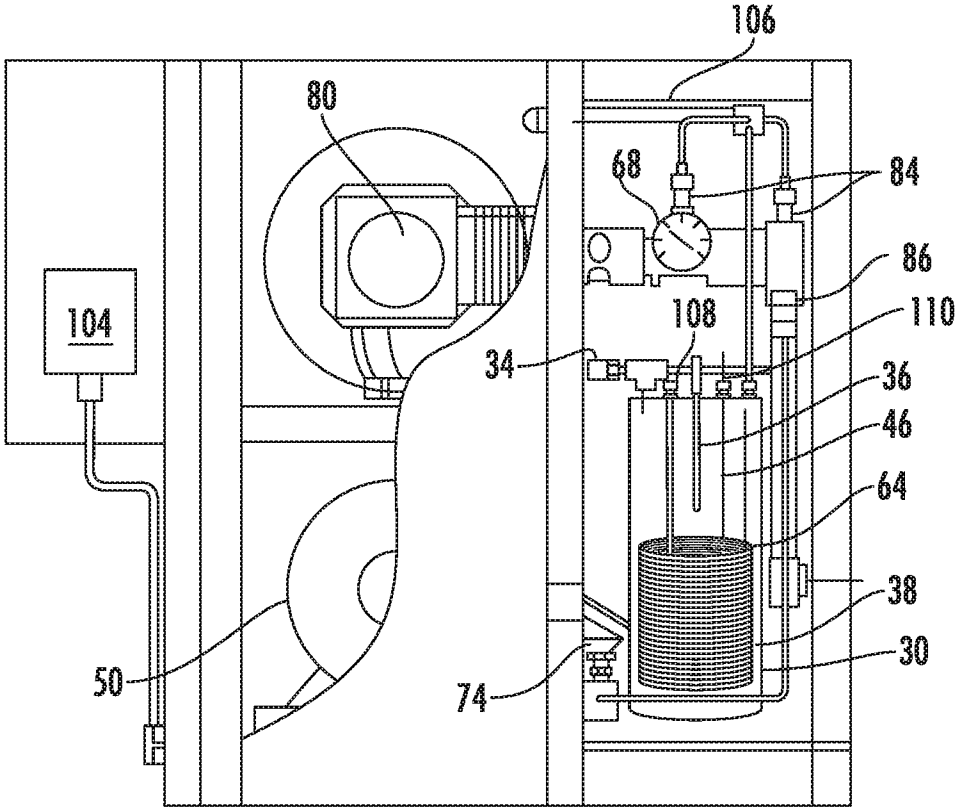
FIG. 5 is a side elevational view of the assembly of FIG. 4.

In another embodiment, shown in FIGS. 4-6, the reservoir 106 could be omitted, and the gas material fed directly from the cooling chamber 30 to the pump 80 via section 66, and then branch 66B, driven by check valve 84B. In such an embodiment, check valve 84B returns leaked gas material to section 66 of the gas line 60 through branch 66A, so it can then be recirculated to the pump 80 through branch 66B. The embodiment of FIGS. 4-6 is otherwise similar to that of FIGS. 1-3

The pump 80 remains cool during pumping, because the gas material is cooled by the cooling chamber 30 prior to reaching the pump 80.

The pump 80 may be an electrically driven positive displacement gas booster pump, which may be, for example, a belt-driven piston pump. The assembly 10 includes an electric motor 50 that drives the pump 80. In the embodiment shown, the electric motor 50 may comprise an enclosed, fan cooled electric motor, though other types of electric motors could be employed as well. The pump 80 compresses and transfers the gas material into a cooling tower 82.

In the example shown, the cooling tower 82 is a conventional-type cooling tower that cools the gas material through a heat exchange process known in the art, prior to the gas material being transferred into a storage container via a final section 70 of gas line 66. The cooling tower 82 includes a check valve 86 to drive the gas material in a direction from the pump 80 and towards the storage container outlet 12 via the section 70 of gas line. The final section 70 of gas line 60 may include a pressure relief valve 72 and gas material thermocouple 74 to ensure proper temperature and pressure of the cooled gas material. Additional pressure relief valves and thermocouples may be provided at others sections of the gas line 60 for similar purposes.

The gas line 60 may also include a bypass section 76 that extends directly between the source 62 and final section 70 and includes a bypass section check valve 88 that drives the gas material directly from the source to the storage container. Bypass valves 78 may be provided for allowing and stopping the flow of gas material via the bypass section 76.

Cooling the gas material by the cooling chamber 30 before it is transferred to the pump 80 mitigates the heat generated during compression by the pump 80, which in turn extends the life of the pump 80. As the temperature of the gas material is reduced in the cooling chamber 30, the density of the gas material is increased, which in turn increases the amount of gas molecules pumped through a given area per unit of time, increasing pumping efficiency and reducing the time required to fill the storage container.

The coolant travels through the assembly 10 via the coolant line 40, traveling out of the coolant vessel 20 through outlet 26, through cooling chamber 30, from the cooling chamber 30 to the cooling tower 82 by way of section 48. During this process, the coolant, which is initially provided in a liquid state, may vaporize. The vaporized coolant is utilized in the cooling process that takes place at the cooling tower 82, and then transported from the cooling tower 82 through final section 54 of coolant line, through vapor return port 24 and back to the coolant vessel 20.

The pumping assembly 10 of the embodiment shown is electrically controlled. As shown in FIG. 1, the system 10 further comprises an electrical control line 90. An electrical control box 92 forms a junction at which multiple sections of the electrical control line 92 meet, for supplying power and controlling the various components of the system 10.

A first section 94 of the electrical control line 90 controls and powers the liquid solenoid valve 32 that regulates liquid level of the cooling chamber 30. A second section 96 of the electrical control line 90 controls and powers the electric motor 50. A third section 98 of the electrical control line 90 controls and powers the gas material thermocouple 74. A fourth section 100 of the electrical control line 90 controls and powers the liquid level thermocouple 36.

The electrical control box 92 may further include an over pressure switch 102 connected with an over pressure section 104 of the gas line 60. Over pressure section 104 is in communication with the final section 70 of gas line 60. Over pressure switch 104 acts as a safety mechanism to cut power to the assembly 10 where the pressure of the gas material in the final section 70 is above a selected threshold, to avoid gas at excessive pressure levels being fed into the storage container.

Figure 7:
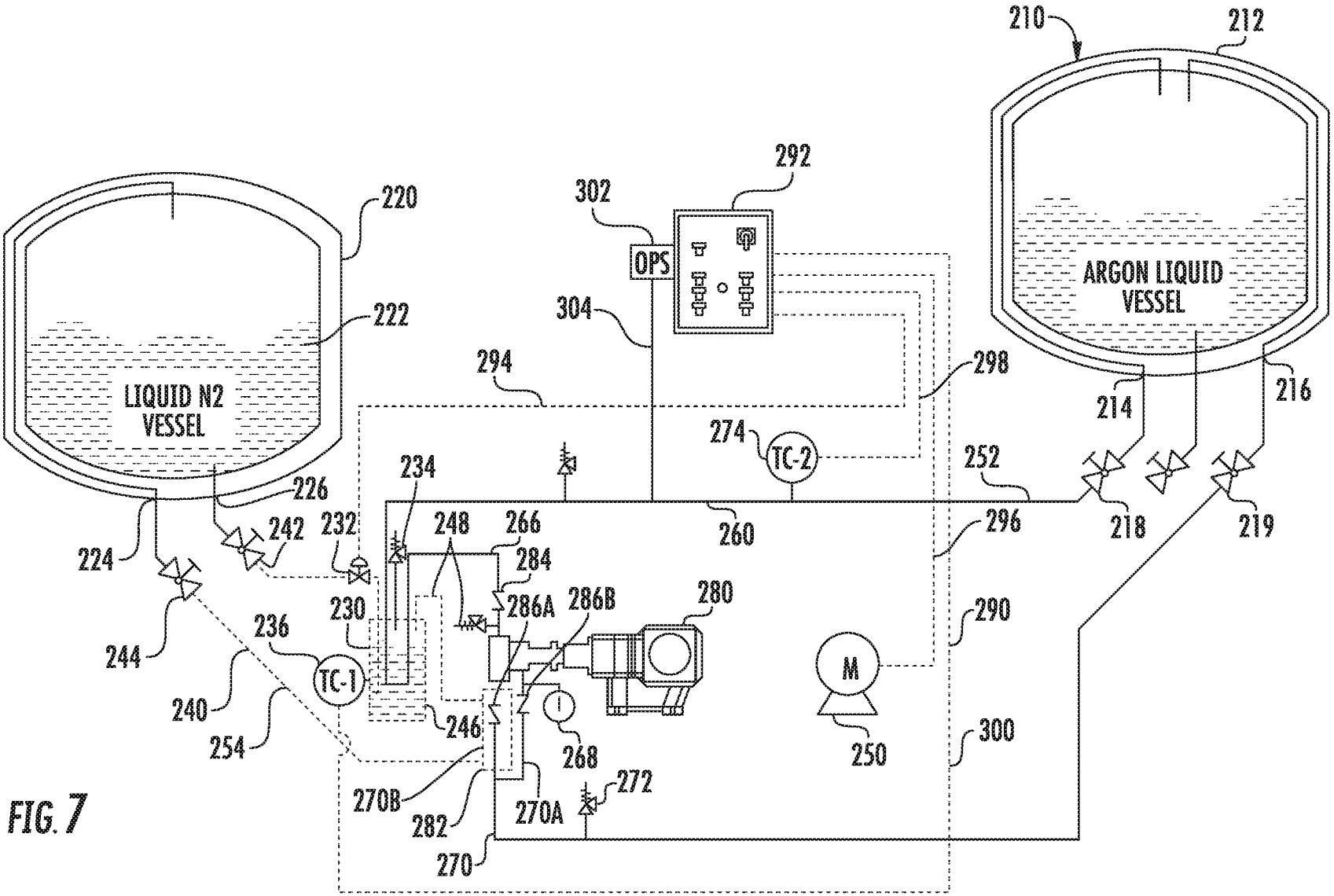
FIG. 7 is a schematic illustration of another embodiment of a gas displacement pump assembly.

Another embodiment of a gas displacement pump assembly 210 is shown in FIG. 7. In this embodiment, the gas material is a cryogenic material, and a pump assembly as shown and described may be use to periodically cool such a cryogenic material to maintain a low volume and storage pressure.

As shown, the assembly 210 comprises a coolant vessel 220 that houses a supply of coolant 222. The vessel 220 is in communication with a cooling chamber 230 via a coolant line 240. The cooling chamber 230 cools a supply of cryogenic material transmitted from a storage container 212 to the cooling chamber 230 via a cryogenic material line 260, in order to take the cryogenic material from a gaseous to a liquid state before returning the cryogenic material back into the storage container 212.

The cryogenic material of the embodiment shown is argon, which is stored as liquid argon and may, over time, vaporize. The vaporized argon is cooled and liquefied using the assembly 210, before being returned to the storage container in liquid form, thereby reducing the internal pressure within the storage container 212.

The coolant 222 of this embodiment is liquid nitrogen. The vessel 220 comprises a vapor return 224 and a liquid supply port 226, each of which is in communication with a section of the coolant line 240.

The coolant line 240 forms a closed loop that commences at the liquid supply port 226, where coolant 222 exits the coolant vessel 220. An exit valve 242 may be located along the coolant line 240 just beyond the liquid supply port 226, for starting and stopping the flow of coolant 222 out from the vessel 220 via the liquid supply port 226. The coolant line 240 then travels through the cooling chamber 230, and through cooling tower 280, before returning to the coolant vessel 220. The coolant line 240 may be formed of any conventional tubing known in the art that is suitable for transport of a coolant material. As shown, the coolant vessel 220 is formed as a chamber having an interior that houses the coolant 222. A return valve 244 may be located along the coolant line 240 just before it reaches the vapor return port 224 and returns to the coolant vessel 220, for starting and stopping the flow of coolant 222 back into the vessel 220.

As shown, the storage container 212 includes a vapor supply port 216 where the cryogenic material flows from the storage container 212 into the cryogenic material line 260 in vapor form, and a liquid return port 214 where the cryogenic material returns to the vessel 220 from the cryogenic material line 260. The liquid return port 214 may include an entry valve 218 for starting and stopping the flow of cryogenic material into the storage container 212, and the vapor supply port 216 may include an exit valve 219 for starting and stopping the flow of cryogenic material into the storage container 212.

The cryogenic material line 260 transmits the cryogenic material through a cooling tower 282, to the pump 280 and through the cooling chamber 230 before returning the cryogenic material to the storage container 212. The cryogenic material line 260 may be formed of tubing material suitable for transport of a cryogenic material in both gaseous and liquid states.

In the example shown, the cooling tower 282 is conventional-type cooling tower that cools the cryogenic material through a heat exchange process known in the art. The cryogenic material line 260 may include first and second check valve 286A, 286B that drive the gas material between the cooling tower 282 and the pump 280. In the embodiment shown, section 270 of the cryogenic material line 260 splits into first 270A and second 270B branches between the pump 280 and cooling tower 282. The cooling tower 282 and check valve 286A are located along branch 270A, and check valve 286B is located along branch 270B. Cryogenic material travels from the cooling tower 282 to the pump 280 through branch 270A. During pumping, some of the cryogenic material may leak. For example, the pump 280 may include a head seal, which may be a common location for such leaks. A seal leak gauge 268 may be provided along branch 270A to detect leaks and pressure differentials at the pump 280. Check valve 286B may also collect any leaked gas material leaked at the pump 280, and route it back to the cooling tower 282 through branch 270B, effectively recirculating any leaked gas material back to the pump 280.

The pump 280 is an electrically driven positive displacement gas booster pump, which may be, for example, a belt-driven piston pump. The assembly 210 includes an electric motor 250 that drives the pump 280. In the embodiment shown, the electric motor 250 is a totally enclosed, fan cooled electric motor, though other types of electric motors could be employed as well.

After pumping, the cryogenic material then travels via the cryogenic material line 260 from the pump 280 to the cooling chamber 230.

As shown, the coolant line 240 and the cryogenic material line 260 meet at the cooling chamber 230, at which point the cryogenic material is further cooled before being returned to the storage container 212 via cryogenic material line 260. The cooling chamber 230 comprises a vacuum insulated receptacle that houses coolant, which is transferred to the cooling chamber 230 via coolant line 240. The coolant is in a liquid state at the cooling chamber 230 and forms a bath 246 within the cooling chamber 230. The cryogenic material line 260 extends into the cooling chamber 230 and forms a tubing coil, which may have the same configuration as tubing coil 64 shown in FIGS. 2 and 3, immersed in the bath 246. The tubing coil could be made of copper to provide optimal heat conduction. The tubing coil is cooled by the bath 246 of coolant material within the cooling chamber 230. The cooling chamber 230 may be provided with a liquid solenoid valve 232 and liquid level thermocouple 236 for controlling the temperature of the bath 246, and a relief valve 234 for controlling the pressure in the cooling chamber 230. The cryogenic material of the embodiment shown may be cooled sufficiently to cause liquefaction thereof. The cryogenic material of the embodiment shown may be cooled to cryogenic temperatures, for example, below −302° F./−185° C. in embodiments in which argon is the cryogenic material.

The cryogenic material line 260 may include a pressure relief valve 272, which is provided within section 270 in the illustrated embodiment, as well as a thermocouple 274, to ensure proper temperature and pressure of the cooled cryogenic material. Additional pressure relief valves and thermocouples may be provided at other sections of the cryogenic material line for the same purposes. At least one check valve 284 may be located along the section 266 cryogenic material line 260 between the cooling chamber 230 and the pump 280, to drive the cryogenic material in a direction towards the cooling chamber 230 and away from the pump 280.

After exiting the cooling chamber 230, the cryogenic material is returned to the storage container 212 via section 252 of cryogenic material line 260.

The cryogenic material stored within the storage container 212 may be repeatedly circulated through the cryogenic material line 260 as described above, in order to maintain low temperatures in the cryogenic material. Over time, the temperature of the cryogenic material 212 within the storage container 212 will increase, and some of the cryogenic material will vaporize and then be recirculated and liquefied according the above-described process.

Storing the cryogenic material in the storage container 212 in a liquid state reduces the internal pressure within the storage container 212, allowing the user to retain a liquid product longer and reduce common expenses resulting from pressure relief devices venting the high pressure vapor into the atmosphere.

The coolant travels through the assembly 210 via the coolant line 240, traveling out of the coolant vessel 220 through outlet 226, through cooling chamber 230, from the cooling chamber 230 to the cooling tower 282 by way of section 248. During this process, the coolant, which is initially provided in a liquid state, may vaporize. The vaporized coolant is utilized in the cooling process that takes place at the cooling tower 282, and then transported from the cooling tower 282 through final section 254 of coolant line, through vapor return port 224 and back to the coolant vessel 220.

The pumping assembly 210 of the embodiment shown is electrically controlled. As shown, the system 210 further comprises an electrical control line 290. An electrical control box 292 forms a junction at which multiple sections of the electrical control line 292 meet, for supplying power and controlling the various components of the system 210.

A first section 294 of the electrical control line 290 powers and controls the liquid solenoid valve 232 that regulates the liquid level of the cooling chamber 230. A second section 296 of the electrical control line 290 powers and controls the electric motor 250. A third section 298 of the electrical control line 290 powers and controls the cryogenic vapor material thermocouple 274. A fourth section 300 of the electrical control line 290 powers and controls the liquid level thermocouple 236.

The electrical control box 292 may further include an over pressure switch 302 connected with the cryogenic material line 360. Over pressure switch 304 acts as a safety mechanism to cut power to the assembly 310 where the pressure of the cryogenic vapor material in is above a selected threshold While the invention has been described with reference to the embodiments above, a person of ordinary skill in the art would understand that various changes or modifications may be made thereto without departing from the scope of the claims.

The invention claimed is:

1. A gas displacement assembly, comprising:

a storage container;

a single pump that pumps a pressurized gas material into the storage container;

a cooling chamber that houses a coolant and that cools the pressurized gas material to a cryogenic temperature, wherein the single pump receives the pressurized gas material from the cooling chamber and pumps the pressurized gas material into the storage container;

a cooling tower, wherein the single pump transmits the pressurized gas material through the cooling tower before the pressurized gas material reaches the storage container to further cool the pressurized gas material; and a coolant line that transports the coolant through the cooling chamber.

2. The gas displacement assembly of claim 1, further comprising a gas line that transports the pressurized gas material through the single pump and to the storage container.

3. The gas displacement assembly of claim 2, further comprising a reservoir located along the gas line that houses a supply of the gas material before the pressurized gas material reaches the single pump.

4. The gas displacement assembly of claim 1, wherein the cooling chamber comprises a bath of the coolant and a coil that transports the pressurized gas material through the bath to cool the gas material to the cryogenic temperature.

5. The gas displacement assembly of claim 1, wherein the pressurized gas material is helium.

6. The gas displacement assembly of claim 1, wherein the pressurized gas material is argon.

7. The gas displacement assembly of claim 1, wherein the cooling chamber cools the pressurized gas material to a cryogenic temperature at which the pressurized gas material liquefies.

8. The gas displacement assembly of claim 1, wherein the cooling chamber cools the pressurized gas material to a cryogenic temperature before the pressurized gas material reaches the single pump.

9. The gas displacement assembly of claim 1, further comprising a motor that drives the single pump.

10. The gas displacement assembly of claim 9, wherein the motor is an electric motor.

11. A gas displacement pump assembly, comprising:

a storage container;

a single pump that pumps a gas material into the storage container;

a vessel housing a supply of coolant;

a cooling chamber;

a coolant line that transfers coolant from the vessel to the cooling chamber;

a gas source; and a gas line that transmits a gas material from the gas source through the cooling chamber and to the pump;

a cooling tower, wherein the single pump transmits the gas material through the cooling tower before the gas material reaches the storage container;

wherein the cooling chamber cools the gas material to a cryogenic temperature before the gas material reaches the single pump.

12. The gas displacement pump assembly of claim 11, wherein the coolant line further transfers coolant to the cooling tower, after the coolant reaches the cooling chamber.

13. The gas displacement single pump assembly of claim 11, further comprising a reservoir that houses a supply of the gas material before the gas material reaches the pump.

14. The gas displacement pump assembly of claim 11, wherein the coolant line further transfers the coolant back to the vessel, after the coolant reaches the cooling chamber.

15. A method of transferring a gas material into a storage container, comprising:

providing the gas material;

providing the storage container;

providing a gas displacement pump assembly having a cooling chamber, a single pump, a vessel housing a supply of coolant, and a coolant line, and a gas line, wherein the pump assembly further comprises a cooling tower;

transmitting coolant from the vessel, and through the coolant line to the cooling chamber;

transmitting the gas material through the gas line into the cooling chamber;

cooling the gas material to a cryogenic temperature in the cooling chamber to generate a cooled gas material;

transmitting the cooled gas material from the cooling chamber to the single pump;

pumping the cooled gas material into the storage container;

transmitting the gas material through the cooling tower after pumping the cooled gas material and before the cooled gas material enters the storage container.

16. The method of claim 15, wherein the cooling chamber comprises a bath of the coolant and a coil, the method further comprising transmitting the gas material through the coil to cool the gas material.

17. The method of claim 15, further comprising transmitting vaporized coolant from the cooling chamber to the cooling tower.

* * * * *